US008005252B2

(12) United States Patent
Connors et al.

(10) Patent No.: US 8,005,252 B2
(45) Date of Patent: Aug. 23, 2011

(54) PERSONAL COMMUNICATIONS EARPIECE

(75) Inventors: Michael Patrick Connors, Scotts Valley, CA (US); Thanh Quoc Nguyen, Irving, TX (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 137 days.

(21) Appl. No.: 12/455,372

(22) Filed: Jun. 1, 2009

(65) Prior Publication Data

US 2009/0238398 A1 Sep. 24, 2009

Related U.S. Application Data

(60) Division of application No. 10/921,080, filed on Aug. 18, 2004, now Pat. No. 7,542,582, which is a continuation-in-part of application No. 09/870,398, filed on May 29, 2001, now abandoned.

(51) Int. Cl.
*H04R 25/00* (2006.01)

(52) U.S. Cl. ..... 381/381; 381/315

(58) Field of Classification Search ..... 381/315, 381/322, 324, 328, 370, 375, 380–381
See application file for complete search history.

(56) References Cited

U.S. PATENT DOCUMENTS

| | | | |
|---|---|---|---|
| 3,862,378 | A | 1/1975 | Norris |
| 4,273,969 | A | 6/1981 | Foley et al. |
| 4,972,468 | A | 11/1990 | Murase et al. |
| 5,031,219 | A | 7/1991 | Ward et al. |
| 5,373,555 | A | 12/1994 | Norris et al. |
| 5,412,736 | A | 5/1995 | Keliiliki |
| 5,606,607 | A | 2/1997 | Yamaguchi et al. |
| 5,606,621 | A | 2/1997 | Reiter et al. |
| 5,729,615 | A | 3/1998 | Yang |
| 5,812,659 | A | 9/1998 | Mauney et al. |
| D411,540 | S | 6/1999 | Mavrakis et al. |
| 5,987,146 | A | 11/1999 | Pluvinage et al. |
| 6,181,801 | B1 | 1/2001 | Puthuff et al. |
| 6,445,799 | B1 | 9/2002 | Taenzer et al. |
| 6,681,022 | B1 | 1/2004 | Puthuff et al. |
| 6,950,531 | B2 | 9/2005 | Rickards |
| 2002/0080989 | A1 | 6/2002 | Chi-Lin |

OTHER PUBLICATIONS

U.S. Appl. No. 09/870,398, Office Action dated May 21, 2003.
U.S. Appl. No. 09/870,398, Office Action dated Feb. 18, 2004.
U.S. Appl. No. 09/870,398, Notice of Abandonment dated Sep. 29, 2004.
U.S. Appl. No. 10/921,080, Office Action dated Sep. 26, 2007.
U.S. Appl. No. 10/921,080, Office Action dated Apr. 8, 2008.
U.S. Appl. No. 10/921,080, Notice of Allowance dated Jan. 27, 2009.

*Primary Examiner* — Suhan Ni
(74) *Attorney, Agent, or Firm* — Larry E. Henneman, Jr.; Henneman & Associates, PLC

(57) ABSTRACT

A personal communications earpiece (10, 10*a*, 10*b*) for use with a personal communications device such as a telephone (50). The personal communications earpiece (10, 10*a*, 10*b*) has an ear hook (12) for placing over an ear (60) of the user. An ear bud (14, 14*a*) containing a speaker (27) is both physically and electrically connected to the ear hook (12) by a flexible connector (16). A front portion (22) of the ear hook (12) extends generally downward in front of the ear (60). In one embodiment, the ear bud (14) has an in ear portion (28) with a plurality of grooves (30) therein for assisting in preventing the ear bud (14) from completely blocking or occluding the ear canal of the user.

15 Claims, 5 Drawing Sheets

PERSONAL COMMUNICATIONS EARPIECE

RELATIONSHIP TO OTHER APPLICATIONS

This application is a divisional of U.S. patent application Ser. No. 10/921,080 filed Aug. 18, 2004 by the same inventors (now U.S. Pat. No. 7,542,582), which is a continuation-in-part of U.S. patent application Ser. No. 09/870,398 filed May 29, 2001 now abandoned by the same inventors, both of which are incorporated herein by reference in their entireties.

TECHNICAL FIELD

The present invention relates to the field of combination microphone and speaker devices for use with two way personal communication systems. The predominant current usage of the present inventive personal communications earpiece is in conjunction with portable "two way" personal communications devices, such as cellular or cordless telephones, two way radios, and the like, wherein it is desirable to have a microphone and speaker combination which will accurately produce sound produced by the device, capture the sound of the user's voice for transmission, and further wherein convenience and comfort are important considerations.

BACKGROUND ART

Personal two way communications devices are becoming ever more popular. The use of cellular telephones is becoming more and more a part of everyday life, and the use of cordless telephone devices continues to increase. Also, the introduction of family radio services two way radios into the market place has greatly increased the popularity and usage of two way radios.

It has long been known in the industry to use a headset for receiving sound from such two way communications devices. Such headsets may contain small speakers placed on or near one or both ears of the user for allowing the user to hear audio signals produced by the communications device. Such headsets may be used with a separate detached microphone, or may be used with a microphone attached thereto. The most common configuration for attached microphones is to place the microphone on a boom arm such that the microphone is near the mouth of the user. However, other configurations are known in the art, such as placing the microphone on a cord hanging from the speaker portion, or otherwise connecting the microphone to the headset mechanism.

While many of the prior art headset devices have adequately produced sound to the user and received sound which is produced by the user, anyone who has used such devices knows that the ideal solution has yet to be produced in the prior art. Among the problems that have existed in the prior art are the fact that a microphone boom is often awkward to use and obtrusive and unsightly to use in public, and may be uncomfortable to wear. Also, the positioning of the microphone often is less than ideal to pick up sound from the user. Furthermore, the sound producing devices of the headset often completely occlude the ear or ears of the user, thus inhibiting the user from hearing outside sounds. This can be inconvenient and even dangerous in certain situations. Another problem is that there can be cross talk between the speakers and the microphone. This is a particular problem where the speaker devices are non-occluding. In such arrangements the amount of sound escaping from the speaker devices is often sufficiently great that it can be picked up by the microphone. Another source of cross talk between the speaker and the microphone is mechanical vibration through the headset.

U.S. Pat. No. 5,606,621, issued to Reiter discloses and claims a hearing aid device that has an earpiece apparatus having a somewhat flexible connector between a behind-the-ear portion and an in-the-ear portion. While there are some superficial similarities between an apparatus designed for use with a hearing and an apparatus designed for use with a two way communications device, each of these types of apparatus has its own particular set of problems which have to be overcome in the design thereof. For example, in a hearing aid device it is desirable to capture generally all available ambient sound in a microphone, whereas in a two way device it is desirable to selectively capture the sound of the user's voice while generally rejecting ambient sounds. As specifically stated in the Reiter patent, the inventor there physically separated components in order to reduce electroacoustic feedback in the device which feedback tends to limit the gain in a necessarily high gain device, such as a hearing aid.

Other than acoustically isolating the microphone from the speaker, the positioning of the microphone is not critical in the hearing aid device, because the microphone is intended to capture ambient sound. Indeed, in a hearing aid it would seem to be optimal to have the microphone coincident with the ear canal, such that sound reaching the microphone would be essentially that which would otherwise enter directly into the ear canal. In the case of the Reiter invention, the inventor seems to have sacrificed that desirable aspect in favor of the necessity of solving the problem which the invention addresses.

On the other hand, in a two way communications unit, such as the present invention, the positioning of the microphone is a primary consideration, since it is desirable to capture the user's own voice, while reducing the amount of ambient sound captured. Electroacoustic isolation of the microphone from the speaker is not a great factor in the communications earpiece, because the communications earpiece is not a high gain device.

It would be advantageous to have a personal communications headset type device which is small and easy to use, and also which both picks up sound from the user and produces sound to the user while minimizing cross talk and noise. However, to the inventors' knowledge, all previous attempts to create such a device have failed to optimize one or more of the above considerations.

DISCLOSURE OF INVENTION

Accordingly, it is an object of the present invention to provide a personal communications combination sound accepting and producing device which is small and easy to use.

It is another object of the present invention to provide a personal communications combination sound accepting and producing device which is comfortable to wear.

It is yet another object of the present invention to provide a personal communications combination sound accepting and producing device which minimizes cross talk between the sound producing device and the sound accepting device.

It is still another object of the present invention to provide a personal communications combination sound accepting and producing device which positions both a microphone and speaker, or equivalent devices, both for efficiency and convenience.

Briefly, a known embodiment of the present invention is an earpiece with a main body which hooks over the ear of the user. The main body has a microphone portion for accepting sound produced by the user. An ear bud is placed in or near the ear canal of the user, for producing sound to be heard by the user. The ear bud is connected to the main body by a flexible connector. The flexible connector isolates the microphone from any vibration which might be produced at the ear bud. The positioning of the microphone is such that sound emitted from the mouth of the user can easily be received, and the ear bud is positioned such that sound produced thereby can be readily heard by the user. Moreover, the relative positioning of the microphone and the ear bud are such that any sound which might be emitted from the ear bud is unlikely to be picked up by the microphone. Further, the design of the ear bud is such that a minimal amount of sound is emitted therefrom, as compared to other possible designs. In a first embodiment of the inventive personal communications earpiece, the personal communications earpiece is connected to a two way personal communications device by a connecting wire. In another embodiment of the invention, the personal communications earpiece is "wireless" between the personal communications earpiece and the two way personal communications device.

These and other objects and advantages of the present invention will become clear to those skilled in the art in view of the description of modes of carrying out the invention, and the industrial applicability thereof, as described herein and as illustrated in the several figures of the drawing. The objects and advantages listed are not an exhaustive list of all possible advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed advantages are not essential elements of the present invention, and should not be construed as limitations.

DETAILED DESCRIPTION OF THE INVENTION

Figure 1:
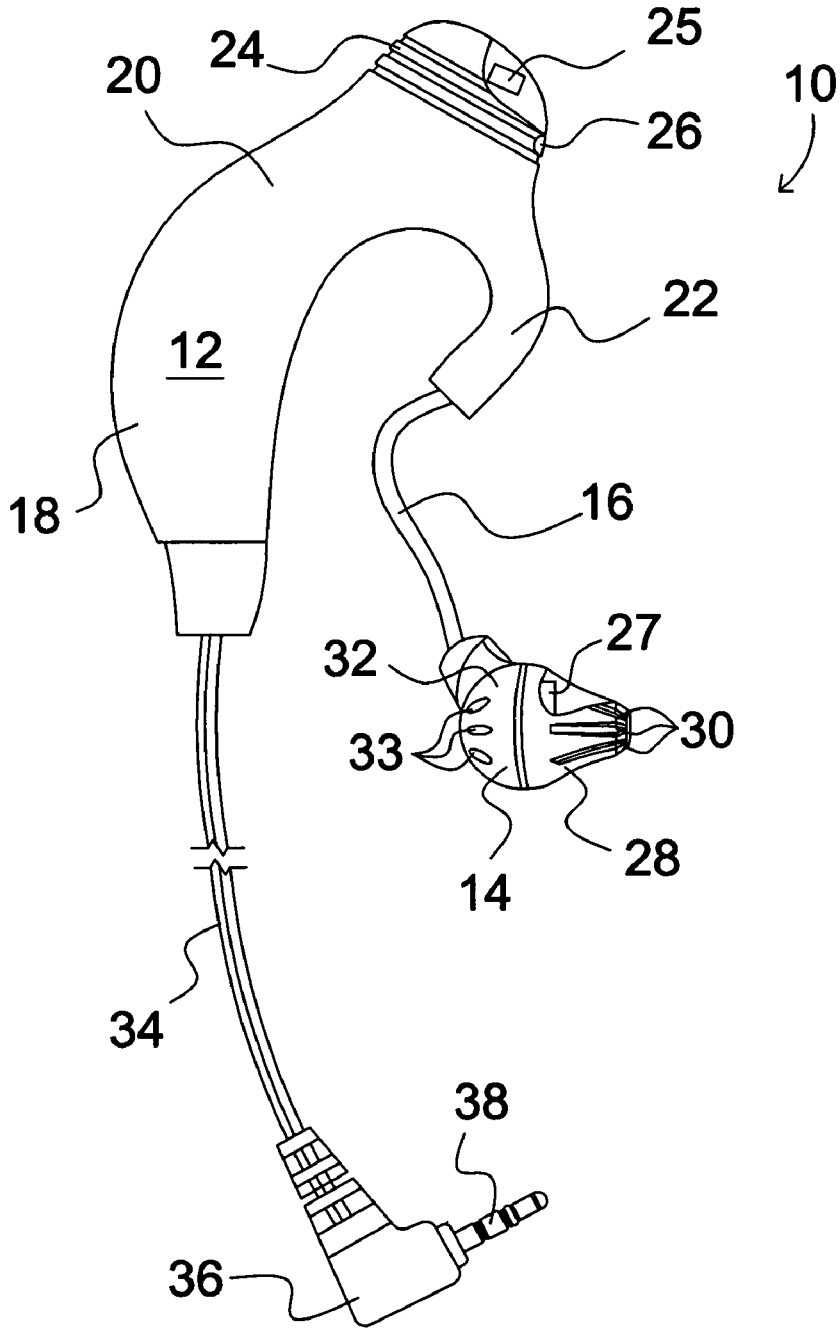
FIG. 1 is a partially cut away side elevational view of a personal communications earpiece, according to the present invention.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

A known mode for carrying out the invention is a personal communications earpiece. The inventive personal communications earpiece is depicted in a partially cut away side elevational view in FIG. 1 and is designated therein by the general reference character 10. The personal communications earpiece 10 has an ear hook 12, an ear bud 14, and a flexible connector 16 which both physically and electrically connects the ear bud 14 to the ear hook 12, and allows substantial rotational, angular and linear displacement freedom of relative movement between the ear bud 14 and the ear hook 12.

In the embodiment 10 of the invention shown in FIG. 1, the ear hook 12 has a behind the ear portion 18, an above the ear portion 20 and a front portion 22, which will be discussed in more detail hereinafter. In the presently described embodiment 10 of the invention, a microphone portion 24 protrudes slightly above the above ear portion 20. The microphone portion 24 contains a microphone element 25, and sound from user's mouth is received by the microphone element 25 through a microphone port 26. The placement of the microphone portion 24, the microphone element 25 and the microphone port 26 shown in the view of FIG. 1 and described herein is optimized for use with the present inventive apparatus, although it is within the scope of the invention that variations in such placement might be useful or desirable in other applications of the invention. The inventors have found that placing the microphone generally as shown in the view of FIG. 1, and as described herein, will allow the microphone to tend to pick up sounds coming from the general direction of the user's mouth, while generally failing to pick up sounds coming from other directions. As previously discussed herein, this is just one of the aspects of the applicability of the invention to two way communications devices.

The ear bud 14 of the presently described personal communications earpiece 10 has a speaker 27 which is normally concealed within an in ear portion 28 of the ear bud 14. In the embodiment 10 shown, the in ear portion 28 is intended to be a non-occluding type, such that the ear canal is not entirely obstructed thereby. It should be noted that, although the embodiment 10 described uses a non-occluding ear bud 14, the invention would be equally applicable if used with a occluding type ear bud (not shown). In this presently described embodiment 10 of the invention, the in ear portion 28 is made of a soft rubber like material, and has a plurality (three are visible in the view of FIG. 1) of grooves 30 for allowing sound to enter the ear therethrough. It is intended that the user not insert this particular example of the ear bud 14 all the way into the ear canal, but rather that the ear bud 14 be lightly placed at the entrance to the ear canal. The ear bud 14 may be supported by either the ear canal or the concha bowl of the ear, at the user's option.

An outside cover 32 is positioned over the speaker 27 at the outer portion of the ear bud 14. The outside cover 32 has a plurality of ports 33 (although it is anticipated that a single port 33 may be used in the future) therein for allowing venting of air driven by the rear side of the speaker 27. One skilled in the art will recognize that some sound will escape from the ear bud 14 through the ports 33 of the outside cover 32. However, in this presently described embodiment 10 of the invention, it is intended that some sound also will escape from the ear canal through the grooves 30 of the in ear portion 18, and further that such sound will be generally out of phase with that emitted from the ports 33 such that these two sources of otherwise unwanted sound emission will tend to cancel each other out in the region around the ear bud external to the ear canal.

In the example of the personal communications earpiece 10 here illustrated, the flexible connector 16 is an electrical cable whereby the ear bud 14 is both physically and electrically connected to the ear hook 12.

Also shown in the view of FIG. 1 are a connector cable 34 and connector 36 for connecting the personal communications earpiece 10 to an external device. The connector 36 will have a plurality (three are shown in this example) of electrical contacts 38 for making contact with mating contacts on the external device. One skilled in the art will recognize that the types of connectors 36 and contacts 38 are not standardized in the industry, and so different types of connectors 36 should be provided for differing applications.

Figure 2:
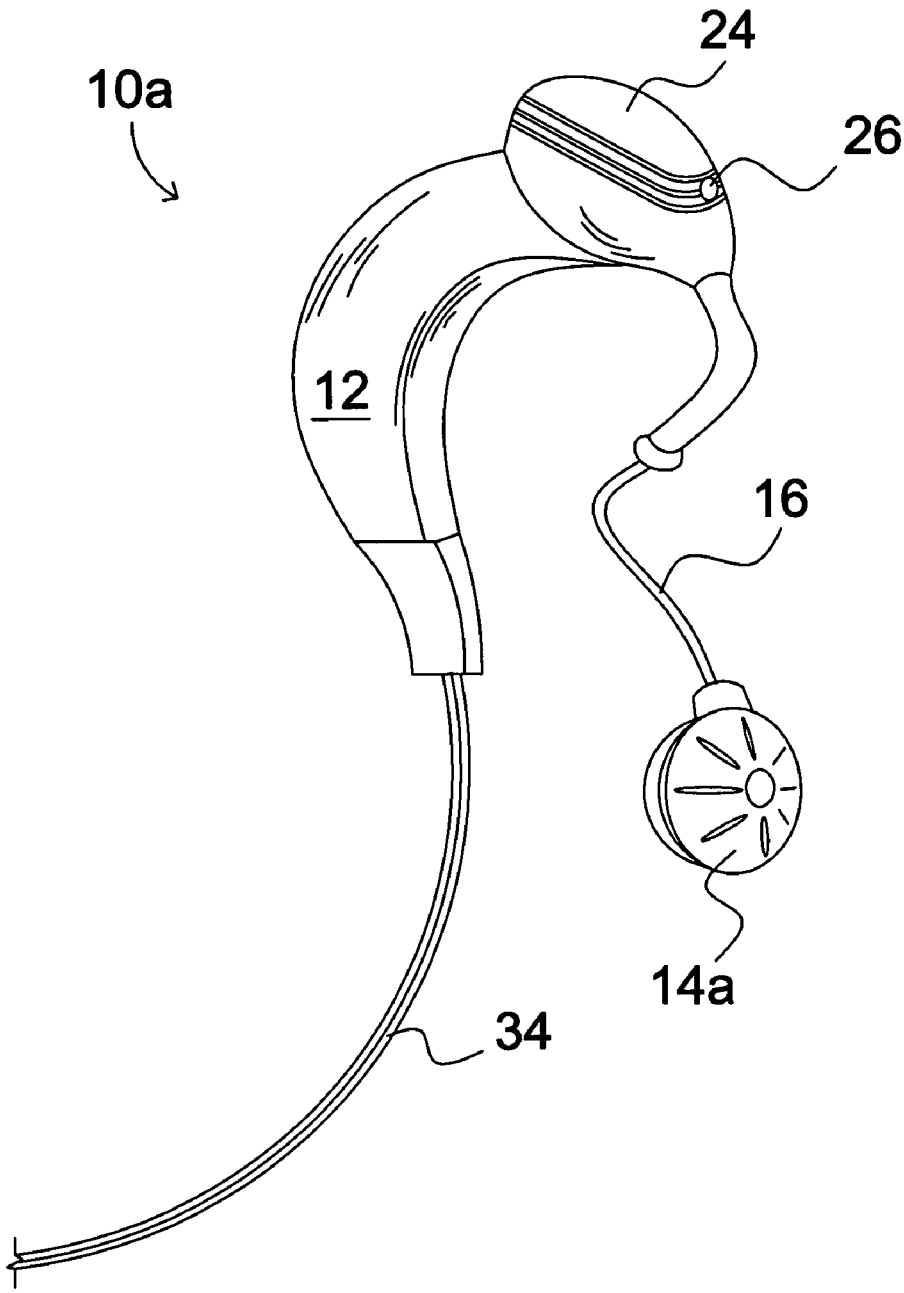
FIG. 2 is a perspective view of the personal communications earpiece of FIG. 1.

FIG. 2 is a perspective view of the example of an alternate embodiment 10*a* of the inventive personal communications earpiece. In the view of FIG. 2, the microphone port 26 can be more readily seen. Also, in the view of FIG. 2, an alternate ear bud 14*a* is depicted. The alternate ear bud 14*a* is a simple enclosed speaker apparatus, such as is well known in the prior art, which might be used in some applications in lieu of the more complicated ear bud 14 previously discussed herein.

Figure 3:
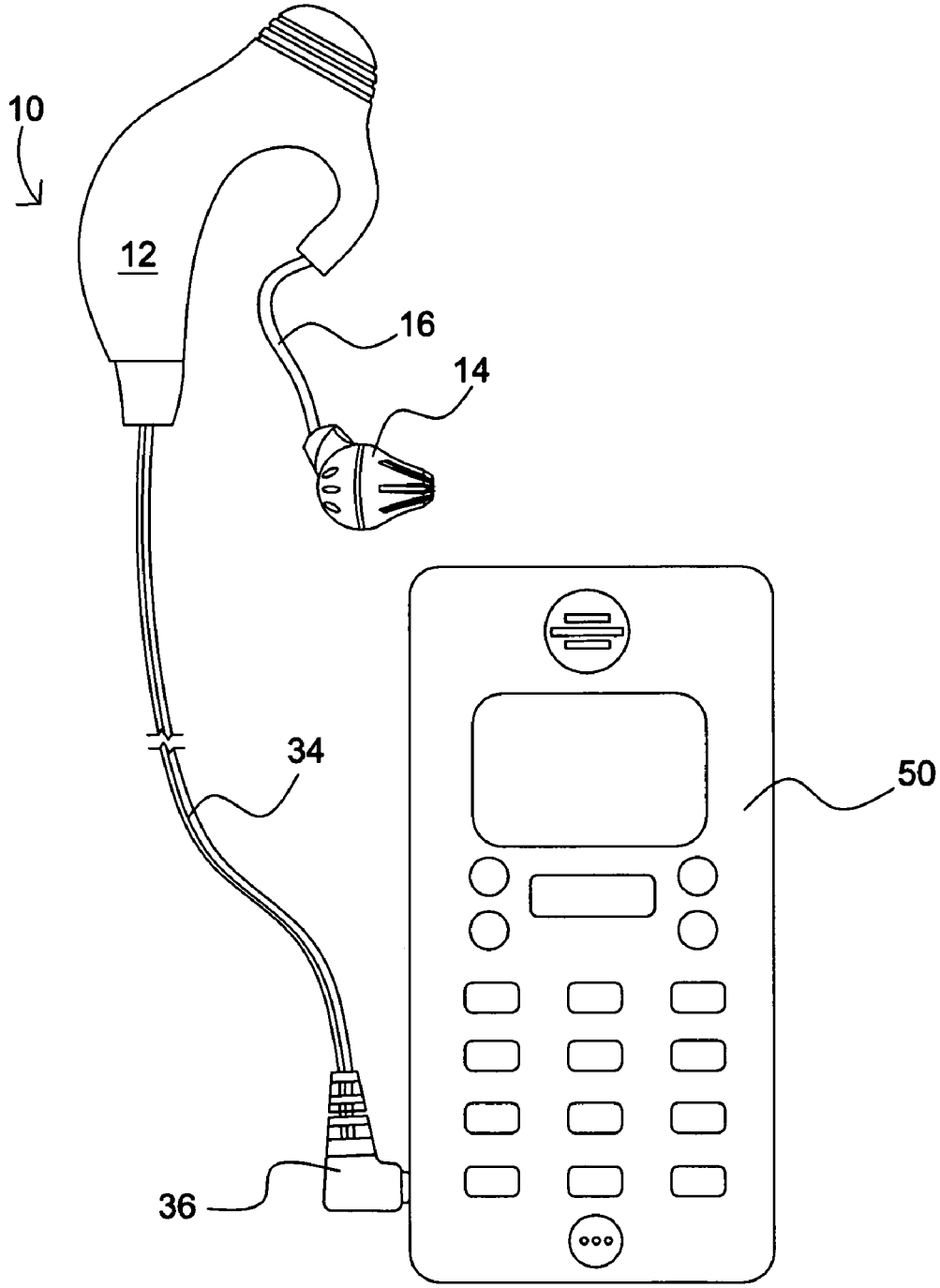
FIG. 3 is an elevational view showing the personal communications earpiece of FIGS. 1 and 2 connected to a telephone.

FIG. 3 is a side elevational view of an example of the personal communications earpiece 10 shown connected to a cellular telephone 50. As previously discussed herein, the cellular telephone 50 shown is only an example of several types of personal communications devices with which the personal communications earpiece 10 might be used. Other alternatives include, but are not limited to, cordless telephone devices, personal two way radio devices, and the like. As was also briefly discussed previously herein, the connector 36 in FIG. 3 is shown by way of example only, since many variations of connectors which are known in the art or which may be developed in the future could be used to connect the personal communications earpiece 10 to the cellular telephone 50 or other such device.

Figure 4:
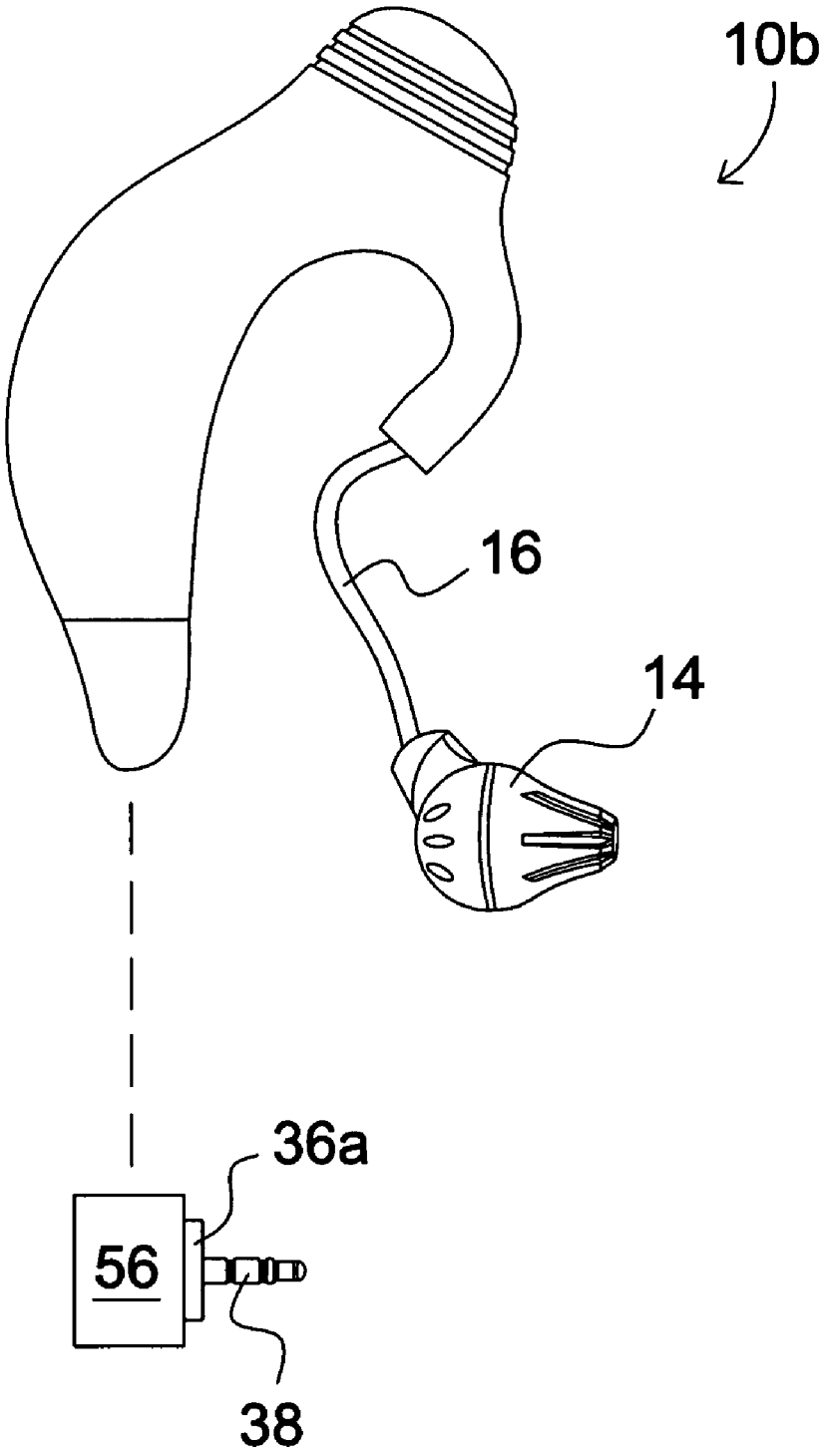
FIG. 4 is a side elevational view of an equally preferred alternate embodiment of the inventive personal communications earpiece.

FIG. 4 is a side elevational view of an equally preferred alternate embodiment 10*b* of the personal communications earpiece 10. As can be seen in the view of FIG. 4, the alternate embodiment 10*b* is much like the first described embodiment 10, except that the alternate embodiment 10*b* does not have the connector cable 34 and connector 36 appended thereto. This is because the alternate embodiment 10*b* is a wireless model. This presently described alternate embodiment 10*b* is intended to communicate via radio frequency signals with a transmitter/receiver device 56. The transmitter receiver device has an alternate connector 36*a* with contacts 38 thereon intended for mating with associated contacts of a personal communications device, such as the cellular telephone 50 of FIG. 3. One skilled in the art will recognize that there are many different possibilities, both existing and yet to be developed, for communicating wirelessly between the alternate embodiment 10*a* of the personal communications device and the transmitter/receiver. Such possibilities include, but are not limited to, various types of radio frequency communication, infra-red communication, and the like. It should also be recognized that the transmitter/receiver 56 need not necessarily be a distinct from the device with which transmitter/receiver 56 is to be used. Indeed, it is anticipated that the functions of the transmitter/receiver 56, as described herein, might be built into future iterations of personal communications devices such as the cellular telephone 50.

Figure 5:
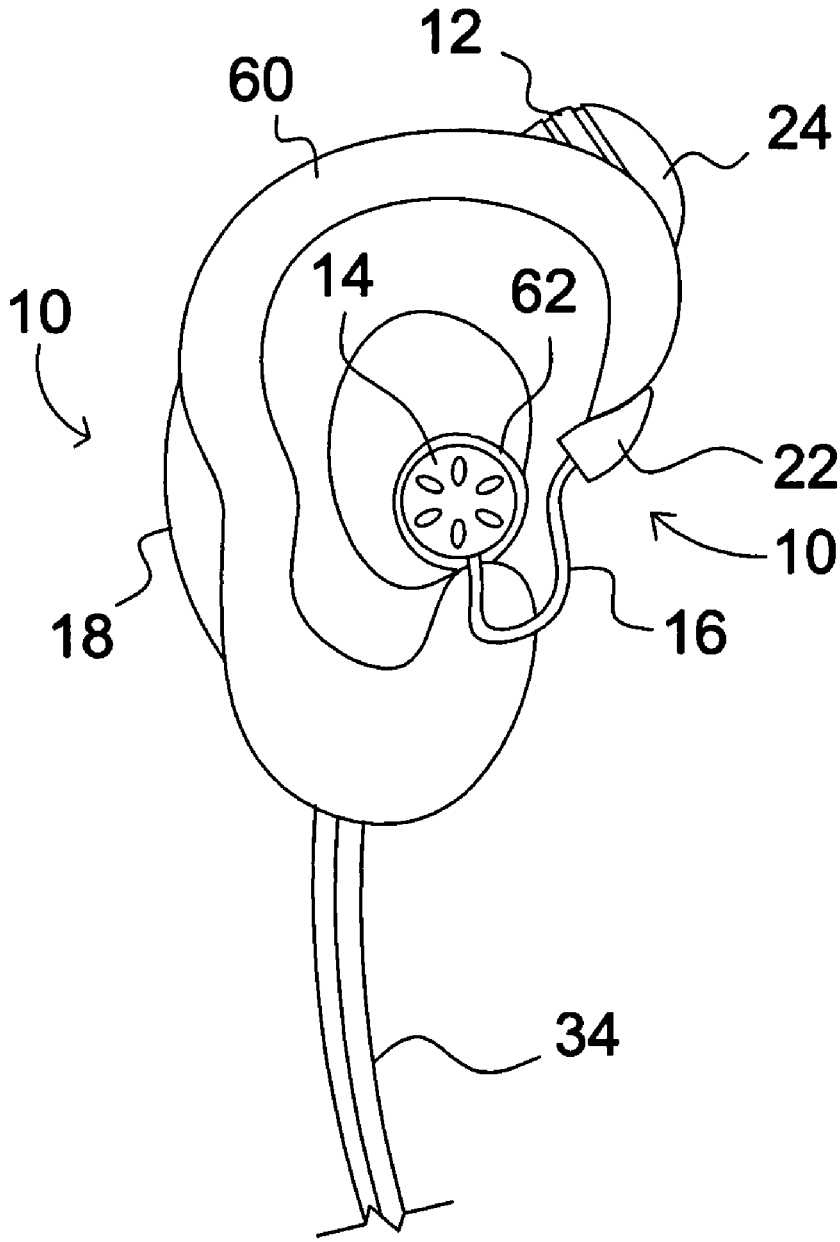
FIG. 5 is a side elevational view of an example of the inventive personal communications earpiece shown In relation to an ear of the user.

FIG. 5 is a side elevational view of an example of the personal communications earpiece 10 positioned on an ear 60. Since the size and shapes of ears vary greatly, the ear 60 of FIG. 5 is presented by way of example only. In the view of FIG. 5 a small part of the behind the ear portion 18 of the ear hook 12 can be seen behind the ear 60, and a part of the microphone portion 24 can be see protruding slightly above the ear. It should be recognized that the parts of the ear hook 12 shown in the view of FIG. 5 might or might not be visible, depending upon the application. It should also be noted that the front portion 22 of the ear hook 12 extends down in front of the ear 60 somewhat farther than is usual in prior art earpiece devices. The ergonomic shape of the ear hook 12 allows the ear hook 12 to be placed comfortably over the ear 60.

As can be seen in the view of FIG. 5, the ear bud 14 is normally placed at the opening an ear canal 62 of the ear 60 and may optionally be placed partially within. It should be recognized that the greater part, if not all, of the ear canal 62 will generally be hidden behind the ear bud 14 when viewed from the perspective of FIG. 5.

Various modifications may be made to the invention without altering its value or scope. For example, the exact shapes of the various parts of the inventive personal communications earpieces 10, 10*a* and 10*b* which are shown and described herein are somewhat arbitrary and intended, in at least some degree, for visual appeal and for making the appearance of the personal communications earpieces 10, 10*a* and 10*b* distinctive. Significant cosmetic changes could be made in the devices without altering their inventive purpose or function.

Another example of an obvious modification which could be made to the inventive personal communications earpieces 10, 10*a* and 10*b* without altering the value or scope of the invention would be to substitute either or both of the microphone element 25 and/or the speaker 27 with equivalent transducer devices, either known or yet to be developed.

It should be noted that, in the first described embodiment 10 of the invention described herein, there is additional electronic circuitry within the body of the ear hook 12 which has not been specifically discussed herein. In this example, this additional circuitry provides amplification and/or noise filtering for the microphone element 25 and amplification for the speaker 27. Further, as briefly discussed herein, the equally preferred alternate embodiment 10*b* of the invention, described above in relation to FIG. 4, will contain additional circuitry for communication with the transmitter/receiver 56, or equivalent device. None of this circuitry is a necessary aspect of the present invention, and one skilled in the art could readily provide such circuitry as might be appropriate to the application.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive personal communications earpieces 10, 10*a* and 10*b* are intended to be widely used in conjunction with a variety of personal communications devices such as cellular and cordless telephones and two way radio devices. Particularly in the case of cellular telephones, it is known that having a hands free type of apparatus provides a significant safety function, particularly when the user is driving an automobile or otherwise engaged in some other activity. The fact that the design of the present inventive personal communications earpieces 10, 10*a* and 10*b* allow the ear bud 14, 14*a* to be placed such that it does not completely block or occlude the ear canal 62 enhances the safety and convenience of the invention, in that the user's hearing is not significantly impaired. Additionally, the fact that the personal communications earpieces 10, 10*a* and 10*b* are comfortable and convenient to wear will increase the likelihood that the devices will be used, as opposed to holding a cellular telephone, or the like, in one hand of the user. The flexible connector 16 not only prevents mechanical cross talk from the ear bud 14, 14*a* to the ear hook 12, but also enhances the user's comfort in that the ear bud 14, 14*a* may be positioned appropriately for the particular user, no matter what the shape of size of the user's ear 60 might be.

The distance from and placement of the ear bud 14, 14*a* in relation to the microphone element 25 of the present inventive personal communications earpieces 10, 10*a* and 10*b* also help to prevent acoustic feedback, as does the tendency of the sound emitted from the ports 33 of the ear bud 14 to be cancelled by sound emitted through the grooves 30 of the in ear portion 28 of the ear bud 14. According to the present invention, such mechanical and acoustic isolation between the speaker 27 and the microphone element 25 is achieved while retaining the convenience of having the speaker 27 and the microphone element 25 joined together as described herein.

According to the present invention, the ear hook 12 is supported separately from the ear bud 14, 14*b*, such that the weight of the entire earpiece 10, 10*a*, 10*b* is not supported by any one portion of the ear 30. Further, as is desirable for use with a two way communications device, the microphone element 25 can be optimally positioned for its intended purpose, while the speaker 27 can also be optimally positioned for its intended purpose, without either physically limiting the placement of the other.

Since the personal communications earpieces 10, 10*a* and 10*b* of the present invention may be readily produced and integrated with existing cellular telephones 50 and other such devices, and since the advantages as described herein are provided, it is expected that it will be readily accepted in the industry. For these and other reasons, it is expected that the utility and industrial applicability of the invention will be both significant in scope and long-lasting in duration.

We claim:

1. A transducer apparatus configured to be worn by a user and for use with a two-way communications device, the transducer apparatus comprising:

an above-the-ear component configured to be supported by the user's ear;

at least one microphone and at least one microphone port, together configured to receive and convert the user's voice to an electrical signal for communication to the two-way communications device;

an in-the-ear component containing a speaker, configured for support of the in-the-ear component, at least in part, by the conchal bowl of the user's ear;

a generally flexible component connecting the above-the-ear component to the in-the-ear component, said generally flexible component providing physical connection between the above-the-ear component and the in-the ear component and allowing support of the in-the-ear component, at least in part, by the conchal bowl of the user's ear; and an interface for providing communication between the transducer apparatus and the two-way communications device.

2. The transducer apparatus of claim 1, wherein:

the above-the-ear component is configured to be generally supported by the top of the user's ear;

the above-the-ear component is configured to be generally retained on the user's head by at least a portion of the above-the-ear component being configured to be positioned between the user's head and the user's ear; and the in-the-ear component is configured to allow placement so as to direct sound from the speaker toward the user's ear canal.

3. The transducer apparatus of claim 1, wherein the generally flexible component is an electrical cable for at least communicating an electrical signal from the above-the-ear component to the in-the-ear component.

4. The transducer apparatus of claim 1, wherein the interface for providing communication between the transducer apparatus and the two-way communications device provides wireless communications between the transducer apparatus and the two-way communications device.

5. A transducer apparatus configured to be worn by a user and for use with a two-way communications device, the transducer apparatus comprising:

a behind-the-ear component configured to be supported by the user's ear;

a microphone configured to transduce the user's voice for communication to the two-way communications device;

an in-the-ear component containing a speaker, with the in-the-ear component configured to be supported, at least in part, by the conchal bowl of the user's ear;

a generally flexible component connecting the behind-the-ear component to the in-the-ear component, the generally flexible component being configured to allow support of the in-the-ear component by the conchal bowl of the user's ear; and an interface for providing communication between the transducer apparatus and the two-way communications device.

6. The transducer apparatus of claim 5, wherein:

the behind-the-ear component is configured to be generally supported by the user's ear and is configured to be generally retained on the user's head in a position over the user's ear; and the in-the-ear component containing the speaker is configured to allow placement so as to direct sound from the speaker toward the user's ear canal.

7. The transducer apparatus of claim 5, wherein the generally flexible component is an electrical cable for at least communicating an electrical signal from the behind-the-ear component to the in-the-ear component.

8. The transducer apparatus of claim 5, wherein the interface for providing communication between the transducer apparatus and the two-way communications device supports wireless communications between the transducer apparatus and the two-way communications device.

9. A transducer apparatus configured to be worn by a user, the transducer apparatus comprising:

an above-the-ear component configured to be supported by the user's ear;

an in-the-ear component containing a speaker, configured for support of the in-the-ear component, at least in part, by the conchal bowl of the user's ear; and a generally flexible component connecting the above-the-ear component to the in-the-ear component, the flexible component providing physical connection between the above-the-ear component and the in-the-ear component and allowing support of the in-the-ear component, at least in part, by the conchal bowl of the user's ear.

10. The transducer apparatus of claim 9, wherein the generally flexible component is an electrical cable for at least communicating an electrical signal from the above-the-ear component to the speaker of the in-the-ear component.

11. The transducer apparatus of claim 10, wherein:

the above-the-ear component is configured to be generally retained on the user's head by at least a portion of the above-the-ear component configured to be positioned between the user's head and the user's ear; and the in-the-ear component is configured to allow placement so as to direct sound from the speaker toward the user's ear canal.

12. The transducer apparatus of claim 11, further including an interface for providing communication between the transducer apparatus and a two-way communications device.

13. The transducer apparatus of claim 12, wherein the interface for providing communication between the transducer apparatus and the two-way communications device supports wireless communications between the transducer apparatus and the two-way communications device.

14. The transducer apparatus of claim 9, wherein:

the in-the-ear component is configured to allow placement so as to direct sound from the speaker toward the user's ear canal;

the in-the-ear component further includes an outside cover covering a rear side of the speaker; and said outside cover include at least one port that allows some sound from the rear side of the speaker to be emitted from the in-the-ear component.

15. The transducer apparatus of claim 14, further including:

at least one microphone and at least one microphone port, together configured to receive and convert the user's voice for communication to a two-way communications device; and wherein the sound from the rear side of the speaker that is emitted from the in-the-ear component is generally out of phase with the sound that escapes from the ear canal, thereby reducing the intensity of the sound generated by the speaker and reaching the microphone port.

* * * * *